US011282436B2

(12) United States Patent
Gai

(10) Patent No.: US 11,282,436 B2
(45) Date of Patent: Mar. 22, 2022

(54) PIXEL CIRCUIT INCLUDING A STORAGE DEVICE CONNECTED TO A CONTROL LINE, DISPLAY DEVICE AND METHOD FOR DRIVING PIXEL CIRCUIT

(71) Applicant: Chengdu Vistar Optoelectronics Co., Ltd., Sichuan (CN)

(72) Inventor: Cuili Gai, Chengdu (CN)

(73) Assignee: Chengdu Vistar Optoelectronics Co., Ltd., Chengdu (CN)

( * ) Notice: Subject to any disclaimer, the term of this patent is extended or adjusted under 35 U.S.C. 154(b) by 0 days.

(21) Appl. No.: 17/222,014

(22) Filed: Apr. 5, 2021

(65) Prior Publication Data

US 2021/0225258 A1 Jul. 22, 2021

Related U.S. Application Data

(63) Continuation of application No. PCT/CN2019/103807, filed on Aug. 30, 2019.

(30) Foreign Application Priority Data

Nov. 29, 2018 (CN) ..... 201811446175.X

(51) Int. Cl.
*G09G 3/20* (2006.01)
*G09G 3/3258* (2016.01)
(Continued)

(52) U.S. Cl.
CPC ..... *G09G 3/2092* (2013.01); *G09G 3/3258* (2013.01); *G09G 3/3266* (2013.01); *G09G 3/3275* (2013.01)

(58) Field of Classification Search
None
See application file for complete search history.

(56) References Cited

U.S. PATENT DOCUMENTS 6,476,786 B1 * 11/2002 Miyachi ..... G09G 3/3648 345/90
2006/0164345 A1 * 7/2006 Sarma ..... G09G 3/30 345/76

(Continued)

FOREIGN PATENT DOCUMENTS

CN 1761986 A 4/2006
CN 1889161 A 1/2007

(Continued)

OTHER PUBLICATIONS

International Search Report dated Nov. 1, 2019 in corresponding International Application No. PCT/CN2019/1038074; 7pages.

(Continued)

*Primary Examiner* — Kirk W Hermann
(74) *Attorney, Agent, or Firm* — Maier & Maier, PLLC

(57) ABSTRACT

A pixel circuit includes a storage device directly connected to a control line so that a light-emitting device may emit light under a control of a control signal from the control line. The pixel circuit further includes: a first transistor; a second transistor; and a third transistor. A control terminal of the first transistor is connected to a first scan line, a second terminal of the first transistor is connected to an output node, and a first terminal of the storage device is connected to the output node. A control terminal of the second transistor is connected to the output node. A control terminal of the third transistor is connected to a second scan line, a second terminal of the third transistor is connected to an anode of the light-emitting device, and a cathode of the light-emitting device is grounded.

17 Claims, 7 Drawing Sheets

(51) Int. Cl.
*G09G 3/3266* (2016.01)
*G09G 3/3275* (2016.01)

(56) References Cited

U.S. PATENT DOCUMENTS

| | | | | |
|---|---|---|---|---|
| 2012/0139959 | A1* | 6/2012 | Kim | G09G 3/3233 345/690 |
| 2014/0118231 | A1* | 5/2014 | Yang | G09G 3/3258 345/82 |
| 2014/0307009 | A1 | 10/2014 | Hasegawa et al. | |
| 2017/0229070 | A1* | 8/2017 | Ma | G09G 3/3291 |
| 2020/0211464 | A1* | 7/2020 | Yue | G09G 3/3225 |
| 2021/0201788 | A1* | 7/2021 | Hu | G09G 3/3275 |

FOREIGN PATENT DOCUMENTS

| | | | | |
|---|---|---|---|---|
| CN | 101276528 | A | | 10/2008 |
| CN | 101312007 | A | | 11/2008 |
| CN | 101800024 | A | | 8/2010 |
| CN | 101996580 | A | | 3/2011 |
| CN | 102708819 | A | | 10/2012 |
| CN | 102768821 | A | | 11/2012 |
| CN | 103440845 | A | | 12/2013 |
| CN | 104200777 | A | | 12/2014 |
| CN | 104200778 | A | | 12/2014 |
| CN | 104409042 | A | | 3/2015 |
| CN | 105096818 | A | | 11/2015 |
| CN | 104200777 | B | * | 4/2017 |
| CN | 105096818 | B | * | 11/2017 |
| CN | 107481664 | A | | 12/2017 |
| CN | 110728946 | A | | 1/2020 |
| KR | 20070120861 | A | | 12/2007 |

OTHER PUBLICATIONS

Office Action dated Nov. 25, 2020 in corresponding Chinese Application No. 201811446175.X; 9 pages.

* cited by examiner

PIXEL CIRCUIT INCLUDING A STORAGE DEVICE CONNECTED TO A CONTROL LINE, DISPLAY DEVICE AND METHOD FOR DRIVING PIXEL CIRCUIT

CROSS REFERENCE TO RELATED APPLICATIONS

The present application is a continuation of international application No. PCT/CN2019/103807 filed on Aug. 30, 2019, and claims priority of a Chinese patent application No. 201811446175.X, entitled "PIXEL CIRCUIT, DISPLAY DEVICE AND METHOD FOR DRIVING PIXEL CIRCUIT" filed Nov. 29, 2018, which is incorporated by reference herein in its entirety.

TECHNICAL FIELD

The present disclosure relates to the field of display technology, and particularly, to a pixel circuit, a display device and a method for driving the pixel circuit.

BACKGROUND

Organic light-emitting diode (OLED) may be classified into a passive matrix organic light-emitting diode (PMOLED) or an active-matrix organic light-emitting diode (AMOLED) according to driving manners. With rapid development of flat panel display technology, in particular, AMOLED display screens have been widely used in electronic display products such as high-end mobile phones and televisions. As a new generation of display technology, Micro LED has higher luminance and greater luminous efficiency, but lower power consumption compared with the existing OLED technology. As a future display solution, Micro LED has also become a hot spot of the research and development in the display field.

SUMMARY

Some embodiments of the present disclosure provide a pixel circuit, a display device and a method for driving the pixel circuit, such that in a case that a storage capacitance of the pixel circuit stays unchanged, luminance of a light-emitting device is controlled through a drive signal transmitted from a control line, thereby promoting a control of luminance of the pixel circuit.

An embodiment of the present disclosure provides a pixel circuit including: a first transistor, a second transistor, a third transistor, a storage device and a light-emitting device. A control terminal of the first transistor is connected to a first scan line, a first terminal of the first transistor is connected to a data line, and a second terminal of the first transistor is connected to an output node; a first terminal of the storage device is connected to the output node, and a second terminal of the storage device is connected to a control line; a control terminal of the second transistor is connected to the output node, a first terminal of the second transistor is connected to a supply voltage, and a second terminal of the second transistor is connected to a first terminal of the third transistor; and a control terminal of the third transistor is connected to a second scan line, a second terminal of the third transistor is connected to an anode of the light-emitting device, and a cathode of the light-emitting device is grounded.

An embodiment of the present disclosure further provides a display device including the pixel circuit described above.

An embodiment of the present disclosure further provides a method for driving a pixel circuit applied to the above-mentioned pixel circuit. The method for driving the pixel circuit includes: controlling, by a first voltage signal output from the first scan line, the first transistor to be in an on-state and controlling, by a third voltage signal output from the second scan line, the third transistor to be in an off-state; transmitting, by the first transistor, a data signal output from the data line to the storage device, and controlling, by the data signal, the storage device to output a first output voltage signal; controlling, by a second voltage signal output from the first scan line, the first transistor to be in an off-state, and controlling, by a fourth voltage signal output from the second scan line, the third transistor to be in an on-state; controlling, by the first output voltage signal of the storage device, the second transistor to be in an on-state, and receiving, by the second transistor through the storage device, a drive signal to drive the light-emitting device through the third transistor; the drive signal including a drive current and/or a drive voltage.

In some embodiments of the present disclosure, compared with the existing technology, it is configured that the control terminal of the second transistor is connected to the output node, the storage device acquires the drive signal transmitted from the control line, the control terminal of the second transistor receives the drive signal transmitted from the control line, and the drive signal controls the luminance of the light-emitting device through the third transistor, so that the light-emitting device emits light under the control of the drive signal and the luminance of the pixel circuit is controllable, thereby realizing an adjustment on luminance of the light-emitting device in a case that a storage capacity of the storage device in the pixel circuit is a certain amount and improving the user's experience. In addition, during a process that the data line transmits a data signal, the first transistor in the pixel circuit is in an on-state, and the third transistor is in an off-state, so that the light-emitting device does not emit light, thereby improving a control on evenness of the luminance of the pixel circuit.

Further, the first transistor and the third transistor are of different types, a voltage signal transmitted from the first scan line and a voltage signal transmitted from the second scan line are same. That is, the voltage signal transmitted from the first scan line and the voltage signal transmitted from the second scan line are both high voltage signals or low voltage signals.

Further, the first transistor and the third transistor are of the same type, a voltage signal transmitted from the first scan line and a voltage signal transmitted from the second scan line are opposite to each other. That is, when one of the voltage signal transmitted from the first scan line and the voltage signal transmitted from the second scan line is a high voltage signal, the other one is a low voltage signal.

Further, the first transistor and the third transistor are switch transistors, while the second transistor is a drive transistor.

In this embodiment, during the process that the data line transmits a data signal to the storage device, the third transistor controls the light-emitting not to emit light, thereby improving a control of the luminance of the light-emitting device.

Further, if the second transistor is a P-type thin-film transistor, the first terminal of the second transistor is a source, and the second terminal of the second transistor is a drain.

Further, the first transistor is a P-type thin-film transistor, and the third transistor is an N-type thin-film transistor; and the control terminal of the third transistor is connected to the control terminal of the first transistor.

Further, the first transistor is a P-type thin-film transistor, and the third transistor is a P-type thin-film transistor.

Further, controlling, by the data signal, the storage device to output a second output voltage signal, and controlling, by a second output voltage signal from the storage device, the second transistor to be in an off-state.

Further, controlling, by the third voltage signal output from the second scan line, the third transistor to be in an off state, such that the light-emitting device is in a non-light-emitting state.

Further, the drive signal is configured to control luminance of the light-emitting device.

Further, in the case that the data signal controls the storage device to be discharged and the second transistor is a P-type thin-film transistor, after the first transistor transmits the data signal output from the data line to the storage device, the method for driving the pixel circuit further includes: controlling, by the data signal, the storage device to be discharged and stopping discharging until the storage device outputs a low voltage signal, transmitting, by the storage device, the low voltage signal thereof to the control terminal of the second transistor; controlling, by the low voltage signal of the storage device, the second transistor to be in an on-state; wherein, the first output voltage signal is the low voltage signal of the storage device.

Further, in the case that the data signal controls the storage device to be charged and the second transistor is a P-type thin-film transistor, after the first transistor transmits the data signal output from the data line to the storage device, the method for driving the pixel circuit further comprises: controlling, by the data signal, the storage device to be charged and stopping charging until the storage device outputs a high voltage signal, transmitting, by the storage device, the high voltage signal thereof to the control terminal of the second transistor; controlling, by the high voltage signal of the storage device, the second transistor to be in an off-state; wherein, the second output voltage signal is the high voltage signal of the storage device.

DETAILED DESCRIPTION

For a high-end display product, an active array is generally adopted in a pixel drive circuit. However, a mainstream active drive array circuit is driven by an analog signal. Thus, there are such problems as high power consumption in the circuit, susceptibility of the signal to interference, and high dependence on consistency of drive devices or on a compensation circuit. A digitally driven pixel circuit has such advantages as low power consumption, less susceptibility of the signal to interference and high tolerance for the consistency of the drive devices. Due to a small pixel size in a high-pixel-density display product, a storage capacitance is too small in the pixel design of a digitally driven circuit, and luminance of a light-emitting device cannot be accurately controlled or adjusted, resulting in luminance uneven of the pixel circuit.

Figure 1:
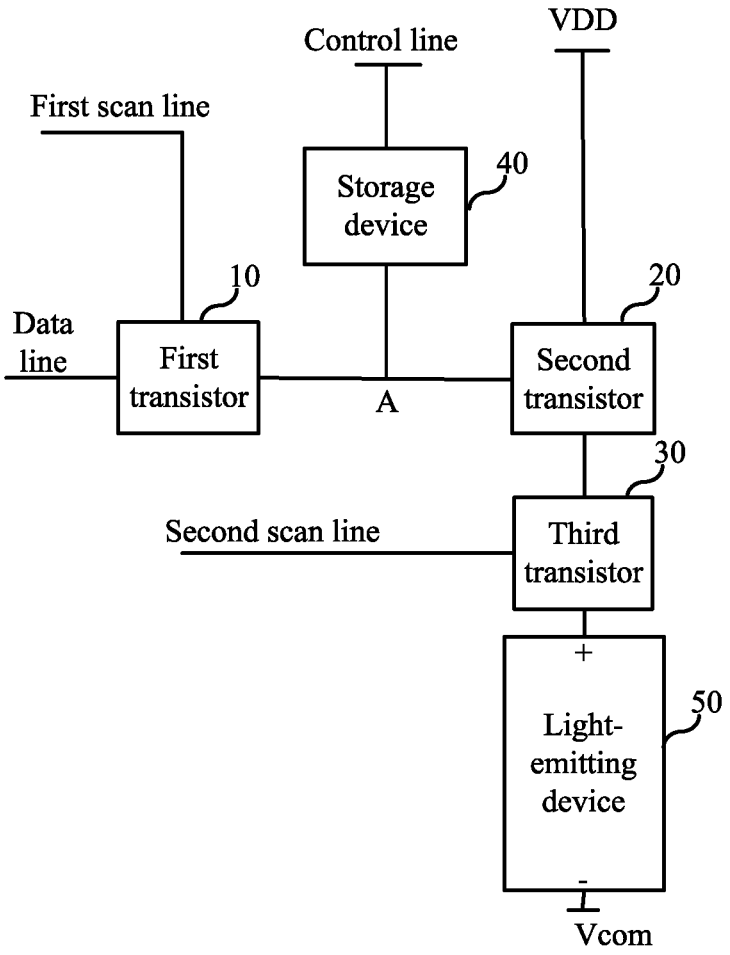
FIG. 1 shows a structural diagram of a pixel circuit according to the present disclosure.

An embodiment of the present disclosure relates to a pixel circuit with a structure as shown in FIG. 1, and the pixel circuit includes a first transistor 10, a second transistor 20, a third transistor 30, a storage device 40 and a light-emitting device 50.

A control terminal of the first transistor 10 is connected to a first scan line, a first terminal of the first transistor 10 is connected to a data line, and a second terminal of the first transistor 10 is connected to an output node. A first terminal of the storage device 40 is connected to the output node, and a second terminal of the storage device 40 is connected to a control line. A control terminal of the second transistor 20 is connected to the output node, a first terminal of the second transistor 20 is connected to a supply voltage, and a second terminal of the second transistor 20 is connected to a first terminal of the third transistor 30. A control terminal of the third transistor 30 is connected to a second scan line, a second terminal of the third transistor 30 is connected to an anode of the light-emitting device 50, and a cathode of the light-emitting device 50 is grounded.

The first transistor 10 and the third transistor 30 are of different types, for example, the first transistor 10 is a P-type thin-film transistor, and the third transistor 30 is an N-type thin-film transistor. Alternatively, the first transistor 10 is an N-type thin-film transistor, and the third transistor 30 is a P-type thin-film transistor. The first transistor 10 and the third transistor 30 may further be of the same type, for example, both the first transistor 10 and the third transistor 30 are P-type thin-film transistors. In this embodiment, it is taken as an example for description that the first transistor 10 is a P-type thin-film transistor and the third transistor 30 is an N-type thin-film transistor. In this embodiment, the light-emitting device 50 may be of varied current-driven, including LED or OLED; or the light-emitting device 50 may be of another type. In this embodiment, OLED is taken as an example for describing an operation principle of the pixel circuit. Specific implementation details may be adaptively adjusted according to an actual used light-emitting device 50 and are not limited herein.

In one embodiment, the first transistor 10 and the third transistor 30 are of different types, and a voltage signal transmitted from the first scan line and a voltage signal transmitted from the second scan line are the same. In another embodiment, the first transistor 10 and the third transistor 30 are of the same type, while a voltage signal transmitted from the first scan line and a voltage signal transmitted from the second scan line are opposite.

The first transistor 10 and the third transistor 30 are switch transistors, while the second transistor 20 is a drive transistor.

The switch transistors are in an on-state or off-state under the action of the voltage signal transmitted from the scan line. A control terminal of the second transistor 20 is connected to an output node A, a source of the second transistor 20 is connected to a supply voltage, and a drain of the second transistor 20 is connected to a first terminal of the third transistor 30. The control line is connected to the second terminal of the storage device 40, the control line transmits a drive signal to the output node A through the storage device 40, the control terminal of the second transistor 20 receives the drive signal transmitted from the control line through the output node A, and the drive signal is used to control luminance of the light-emitting device 50. As shown in FIG. 1, a connection manner of the switch transistors is as follows: the control terminal of the first transistor 10 is connected to the first scan line, and the control terminal of the third transistor 30 is connected to the second scan line.

In a pixel circuit structure, a gate of the first transistor 10 is connected to the first scan line, and either a source or a drain of the first transistor 10 is connected to the data line. A gate of the second transistor 20 is connected to the output node A, and a source of the second transistor 20 is connected to the supply voltage. A gate of the third transistor 30 is connected to the second scan line, and either a source or a drain of the third transistor 30 is connected to the light-emitting device 50. Connection manners of the above-mentioned devices just serve as examples but do not constitute a limitation.

The pixel circuit is driven and involves a data writing stage and a light emitting stage during a light-emitting period. It shall be noted that the light-emitting device 50 may be controlled to be in a light-emitting state or a non-light-emitting state. For example, a digital signal "1" denotes that the light-emitting device 50 emits light, while a digital signal "0" denotes that the light-emitting device 50 does not emit light. The pixel circuit with either the digital signal"1" or the digital signal "0" includes a data writing stage and a light enable stage, and the difference is that the light-emitting device 50 in the light emitting stage of the digital signal "1" is in a light-emitting state, while the light-emitting device 50 in a light emitting stage of the digital signal "0" is in the non-light-emitting state.

In a specific implementation, the pixel circuit structure in FIG. 1 is taken as an example. If both the first transistor 10 and the second transistor 20 are P-type thin-film transistors, the third transistor 30 is an N-type thin-film transistor; the P-type thin-film transistors are controlled to be in an on-state under the action of a low voltage signal from a gate thereof or to be in an off-state under the action of a high voltage signal from a gate thereof; the N-type thin-film transistor is controlled to be in an on-state under the action of a high voltage signal from a gate thereof or to be in an off-state under the action of a low voltage signal from a gate thereof. Voltage signals transmitted from the first scan line and the second scan line are the same (i.e. voltage signals transmitted from the first scan line and the second scan line both are high voltage signals or low voltage signals) due to that the first transistor 10 and the third transistor 30 are of different types. Therefore, the control terminal of the first transistor 10 and the control terminal of the third transistor 30 may be connected to the same scan line. In terms of the digital signal "1", in a data writing stage: a voltage signal transmitted from the scan line is a low voltage signal, the first transistor 10 is in an on-state, the data line transmits a data signal to the storage device 40, the storage device 40 is discharged until the output node A is at a low voltage, and the data signal is stored in the storage device 40; under a control of the low voltage of the output node A, the second transistor 20 is in an on-state, and the third transistor 30 is in an off-state due to that the first transistor 10 and the third transistor 30 are of different types. In a light emitting stage: a voltage signal transmitted from the scan line is a high voltage signal, the first transistor 10 is in an off-state, the third transistor 30 is in an on-state, and the second transistor 20 receives a drive signal transmitted from the control line and transmits the drive signal through the third transistor 30 to the light-emitting device 50 to control luminance of the light-emitting device 50.

In terms of the digital signal "0", in a data writing stage: a voltage signal transmitted from the scan line is a low voltage signal, the first transistor 10 is in an on-state, the third transistor 30 is in an off-state, the data line transmits a data signal to the storage device 40, the storage device 40 is charged until the output node A is at a high voltage, and the data information is stored in the storage device 40, and the second transistor 20 is in an off-state under a control of a high voltage of the output node A. In a light emitting stage: a voltage signal output from the scan line is a high voltage signal, the first transistor 10 is in an off-state, the third transistor 30 is in an on-state, and the second transistor 20 is in an off-stage under a control of the high voltage of the output node A (that is, a circuit for the light-emitting device 50 is open), so that the light-emitting device 50 is in a non-light-emitting state.

In the above control process, in the data writing stage, due to the action of the third transistor 30 (i.e. the third transistor 30 is in an off-state), the light-emitting device OLED is in a non-light-emitting state.

In this embodiment, the second transistor 20 is a drive transistor. The control terminal of the second transmitter 20 is connected to the output node A and receives a drive signal transmitted from the control line through the storage device 40. The drive signal controls luminance of the light-emitting device 50 in the light emitting stage, so that the pixel circuit realizes the control of the luminance evenness of the light-emitting device 50 in a case that capacity of the storage device 40 is limited. In this way, the manner that the luminance of the light-emitting device is controlled by a drive signal output from the control line, improves a user's experience.

The above description serves as only an example that does not constitute a limitation to technical solutions of the present disclosure.

The control terminal of the second transistor is configured to be connected to the output node, the storage device acquires the drive signal transmitted from the control line, the control terminal of the second transistor receives the drive signal transmitted from the control line, and the drive signal controls the luminance of the light-emitting device through the third transistor, so that the light-emitting device emits light under the control of the drive signal, making light-emitting luminance of the pixel circuit controllable and realizing an adjustment of luminance of the light-emitting device in a case that a storage capacity of the storage device in the pixel circuit is a certain amount thereby improving the user's experience. In addition, due to that the first transistor and the third transistor are of different types, the first transistor in the pixel circuit is in an on-state, while the third transistor is in an off-state, so that the light-emitting device does not emit light during a transmission of the data signal from the data line, thereby improving the control of the luminance evenness of the pixel circuit.

Another embodiment of the present disclosure relates to a pixel circuit. This embodiment is generally identical with the above embodiment, but is mainly distinguished in that: a particular structure of the pixel circuit is provided in this embodiment as shown in FIG. 2 and FIG. 3.

A third transistor T3 is configured to control the light-emitting device OLED not to emit light during the data writing stage. Both a first transistor T1 and the third transistor T3 are switch transistors with the same type or different types. Particularly, in a pixel circuit shown in FIG. 2, the first transistor T1 and the third transistor T3 are switch transistors with different types while in a pixel circuit shown in FIG. 3, the first transistor T1 and the third transistor T3 are switch transistors with the same type.

Figure 4:
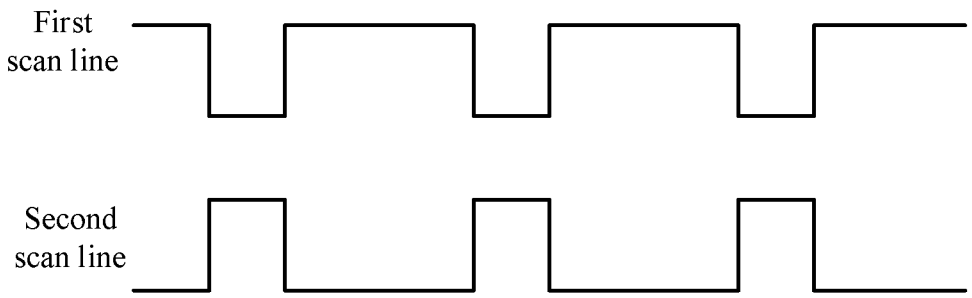
FIG. 4 shows a timing diagram of a voltage of a scan signal in the second pixel circuit according to the present disclosure.

In a pixel circuit, in order to achieve a precise control of luminance of the light-emitting device and improve display effect, the light-emitting device is controlled not to emit light in the data writing stage, and to emit light according to the data information in the light emitting stage, so as to realize a strict control of a luminance gray scale of a display screen of the pixel circuit, and the luminance of the light-emitting device is controlled through a drive signal transmitted from the control line. The third transistor T3 is connected in series with the light emitting device OLED, and the control terminal of the third transistor receives a control of a voltage signal transmitted from the second scan line. Particularly, in the case that the first transistor T1 and the third transistor T3 are of the same type, to ensure that the first transistor T1 is in an on-state and that the third transistor T3 is in an off-state during the data writing stage, a voltage signal transmitted from the first scan line is opposite to a voltage signal transmitted from the second scan line (i.e. when one of the voltage signal transmitted from the first scan line and the voltage signal transmitted from the second scan line is a high voltage signal, the other one is a low voltage signal), as shown in FIG. 4 illustrating a timing diagram of the voltage signal transmitted from the first scan line and of the voltage signal transmitted from the second scan line. In the case that the first transistor T1 and the third transistor T3 are of different types, as shown in FIG. 2, the first transistor T1 is a P-type thin-film transistor and the third transistor T3 is an N-type thin-film transistor. Under a control of the same voltage signal, the first transistor T1 and the third transistor T3 are in different states. For example, under a control of a low voltage signal, the first transistor T1 is in an on-state and the third transistor T3 is in an off-state. Therefore, both the control terminal of the first transistor T1 and the control terminal of the third transistor T3 are connected to the same scan line; or the voltage signals transmitted from the first scan line and from the second scan line are the same.

Figure 2:
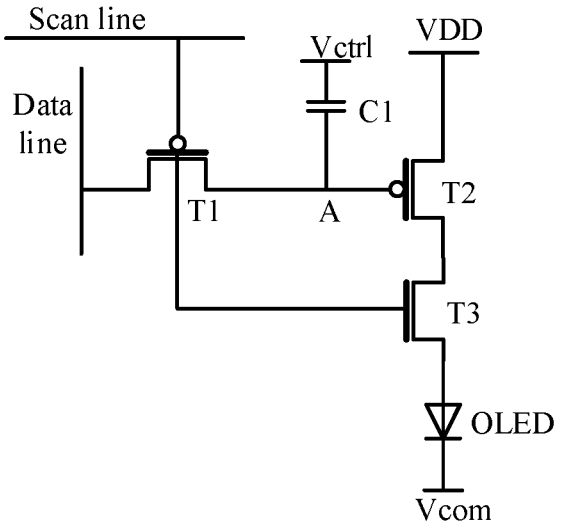
FIG. 2 shows a circuit diagram of a first pixel circuit as a particular structure of the pixel circuit showed as FIG. 1 according to the present disclosure.
Figure 3:
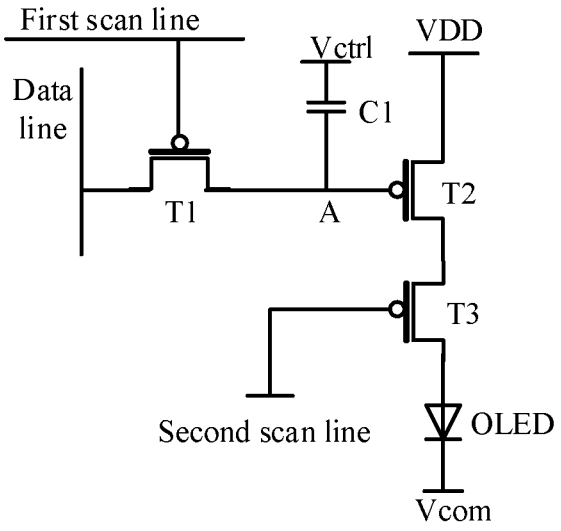
FIG. 3 shows a circuit diagram of a second pixel circuit as another particular structure of the pixel circuit showed as FIG. 1 according to the present disclosure.

In FIG. 2, the first transistor T2 and the second transistor T2 are P-type thin-film transistors, and the third transistor T3 is an N-type thin-film transistor. Because the voltage signals transmitted from the first scan line and from the second scan line are required to be the same, the control terminal of the third transistor T3 is connected to the control terminal of the first transistor T1. In FIG. 3, the first transistor T1, the second transistor T2 and the third transistor T3 are all P-type thin-film transistors. In FIG. 2 and FIG. 3, the light-emitting devices are all OLEDs, and storage devices are all capacitance elements C1.

In FIG. 3, the first transistor T1, the second transistor T2 and the third transistor T3 of the pixel circuit are all P-type thin-film transistors. Thus, it may be considered that the pixel circuit is a pure P-type pixel circuit. The pure P-type pixel circuit may be manufactured using a low temperature poly-silicon process (LTPS), which is advantageous for reducing process difficulty, and thereby is advantageous for promotion and production of the pixel circuit.

Figure 5:
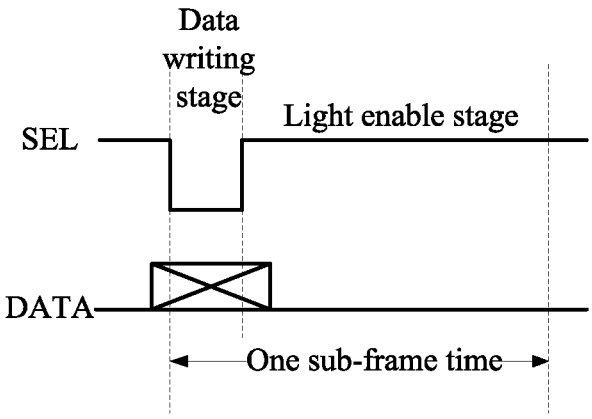
FIG. 5 shows a timing diagram of a pixel circuit during one sub-frame phase according to the present disclosure.

In a specific implementation, a frame of picture is divided into several sub-frames in terms of time, and each sub-frame corresponds to its own scanning period. In a scanning period of a sub-frame, data is written first and then the luminance of the light-emitting device is controlled though a drive transistor. In FIG. 5 illustrating a voltage change during one sub-frame time period, "SEL" denotes a voltage signal output from the scan line, "DATA" denotes a written data, and a drive process of the pixel circuit is shown in terms of the digital signal "1".

In the circuit shown in FIG. 2, the second transistor T2 operates in a saturation region, and a voltage Vgs between a gate and a source of the second transistor T2 is related to a source voltage VDD and Vctrl. Herein, VDD is preset, Vctrl is used for controlling luminance of the light-emitting device to ensure luminance uniformity of the pixel circuit in an entire control panel.

In the pixel circuit, the period of each sub-frame may be different. For example, when the pixel circuit displays one frame, the frame may be divided into several sub-frames in terms of time, and the scanning period of each sub-frame is respectively, 1t, ½t, ¼t, ⅛t . . . ; t represents an entire scanning period of the frame. In one example, when a gray scale of a frame reaches 256, eight sub-frames are required and a period of the eighth sub-frame is $1/128$t.

The above are only examples that do not constitute a limitation to the technical solutions of the present disclosure.

Figure 6:
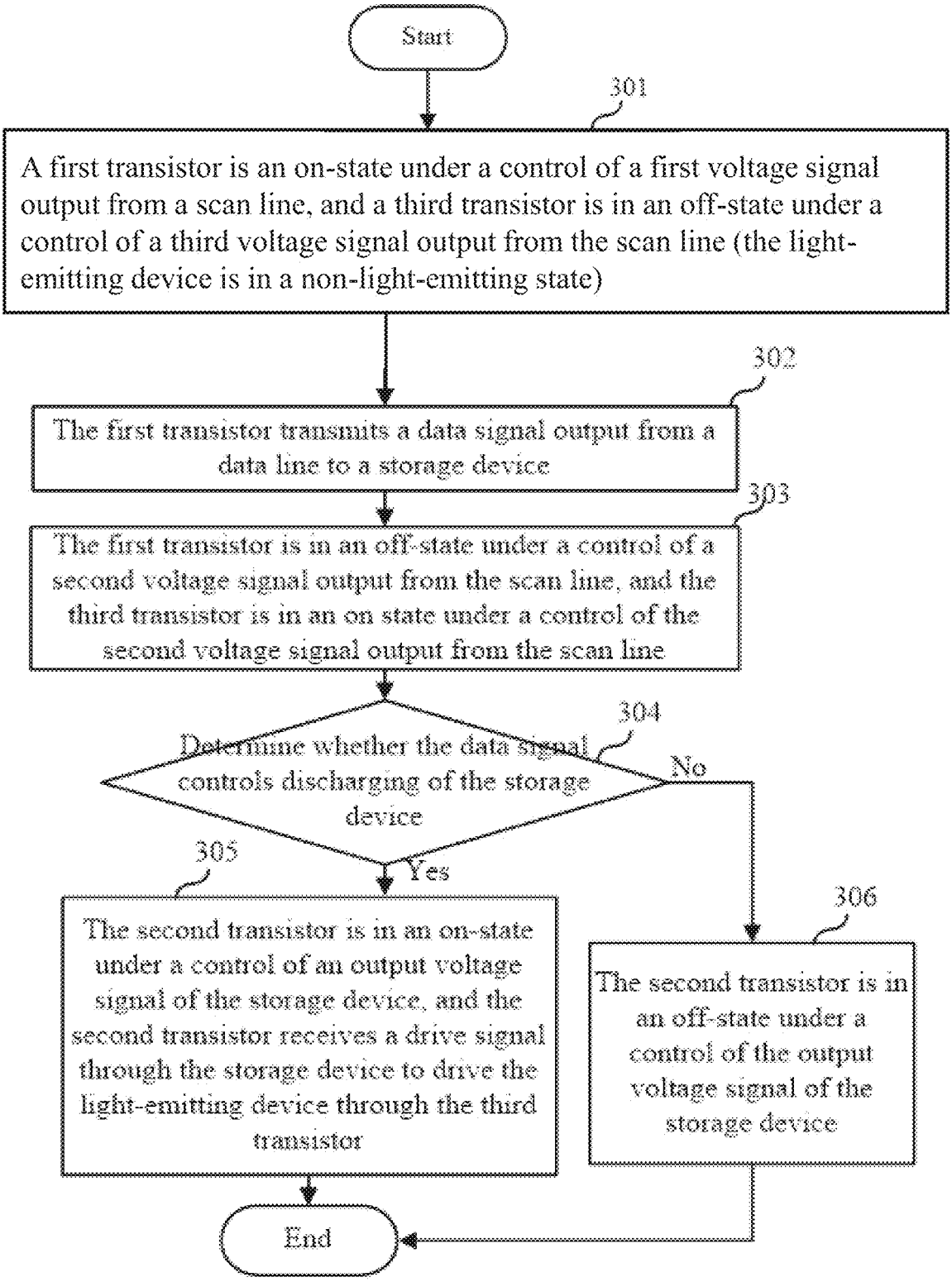
FIG. 6 shows a flowchart of a method for driving a pixel circuit such as the circuit showed in FIG. 1 to FIG. 3 according to the present disclosure.
Figure 7:
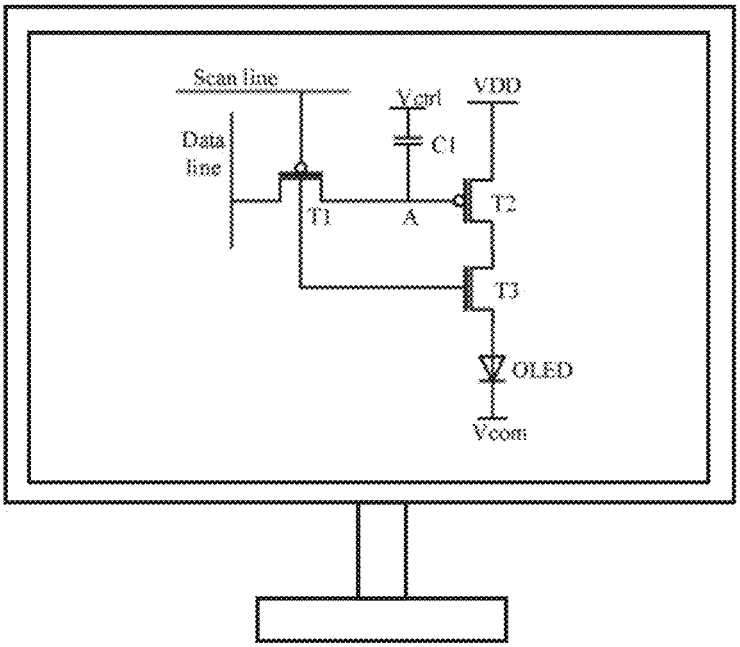
FIG. 7 shows an exemplary display device including the pixel circuit according to the present disclosure.
Figure 8:
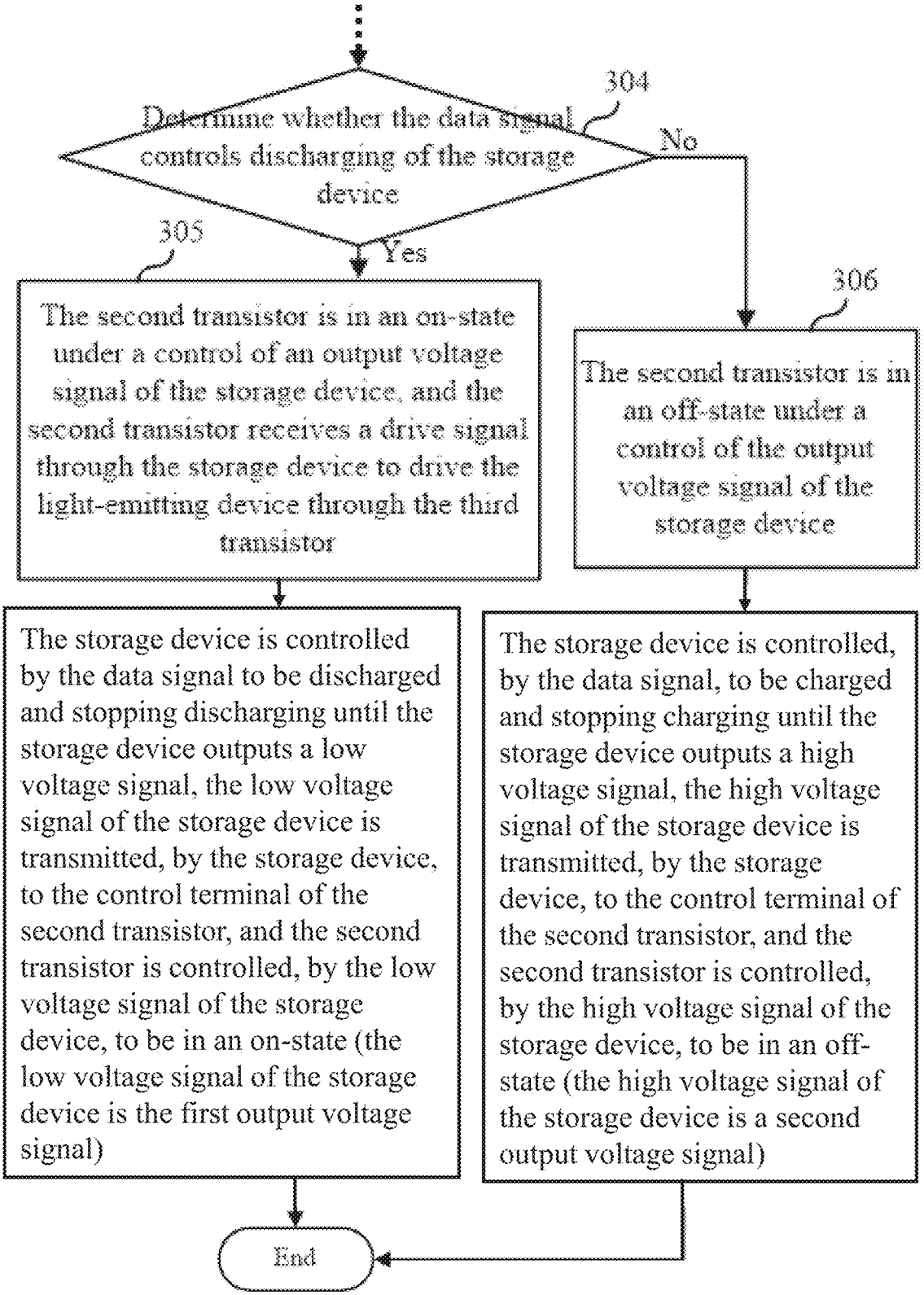
FIG. 8 shows another flowchart of the method for driving the pixel circuit according to the present disclosure.
Figure 9:
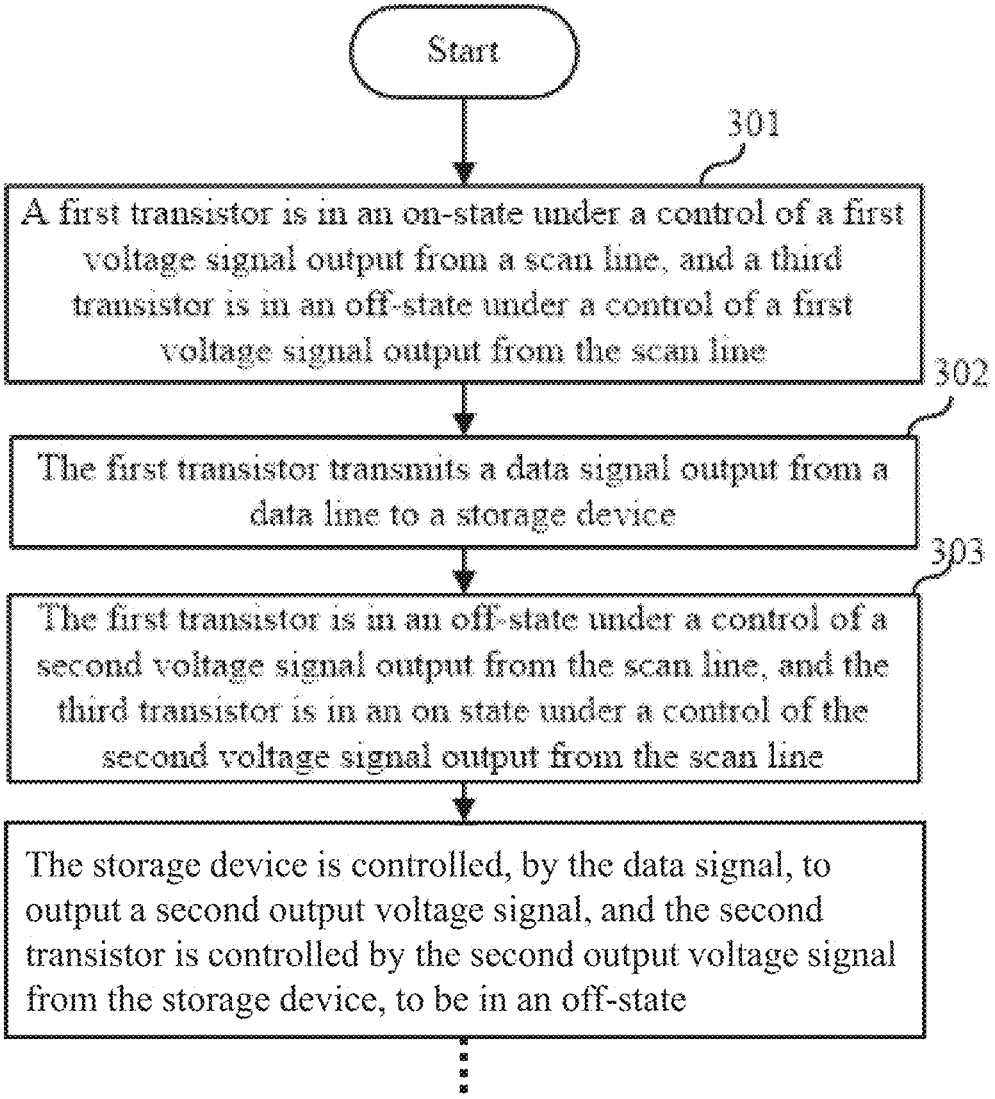
FIG. 9 shows another flowchart of the method for driving the pixel circuit according to the present disclosure.

A further embodiment of the present disclosure relates to a method for driving a pixel circuit applied to the above mentioned embodiment. A flow of the method for driving the pixel circuit is shown in FIG. 6, including the following steps.

In Step 301: the first transistor is in an on-state under a control of a first voltage signal output from the first scan line, and the third transistor is in an off-state under a control of a third voltage signal output from the second scan line.

Correspondingly, because the third transistor is in an off-state under the control of the third voltage signal output from the second scan line, the light-emitting device is in a non-light-emitting state.

The first voltage needs to be set according to the type of the first transistor in the pixel circuit. Here it is only to describe that the first voltage signal controls the first transistor to be in a corresponding state, which particularly is set according to devices in the pixel circuit and is not limited.

In Step 302: the first transistor transmits a data signal output from the data line to the storage device.

During the process that the first transistor transmits the data signal output from the data line to the storage device, the data signal includes digital information, and the data signal controls the charging or discharging of the storage device. After the charging or discharging of the storage device is completed, the first transistor is controlled to be in an off-state.

During the process that the first transistor transmits the data signal output from the data line to the storage device, the third transistor is in an off-state under the control of the third voltage signal output from the second scan line, and the light-emitting device is in a non-light-emitting state. That is, in the data writing stage, the light-emitting device does not emit light.

In Step 303: the first transistor is in an off-state under a control of a second voltage signal output from the first scan line, and the third transistor is in an on-state under a control of a fourth voltage signal output from the second scan line.

In Step 304: it is determined whether the second transistor is in an on-state under the control of a voltage signal output from the storage device. Taking the pixel circuit in FIG. 2 as an example with the second transistor being a P-type thin-film transistor, it is determined whether the data signal controls discharging of the storage device; if it is, step 305 is performed; otherwise, step 306 is performed.

In Step 305: the second transistor is in an on-state under a control of a first output voltage signal from the storage device, the second transistor receives through the storage device a drive signal to drive the light-emitting device through the third transistor.

The drive signal includes a drive current and/or a drive voltage. The drive signal is for controlling the luminance of the light-emitting device.

The drive signal includes a drive current or a drive voltage. Different drive signals are set based on characteristics of the light-emitting device. A drive signal set for a current-driven light-emitting device is a drive current, while a drive signal set for a voltage-driven light-emitting device is a drive voltage. If light-emitting devices include both a current-driven light-emitting device and a voltage-driven light-emitting device, the drive signal includes a drive current and a drive voltage.

In a specific implementation, the data signal controls the storage device to be discharged. After the first transistor transmits the data signal output from the data line to the storage device, the method further includes: the data signal controls the storage device to be discharged and the storage device stops discharging until the storage device outputs a low voltage signal which is then transmitted to the control terminal of the second transistor, the low voltage signal of the storage device controls the second transistor to be in an on-stage and the low voltage signal of the storage device is defined as a first output voltage signal in the case that the second transistor is a P-type thin-film transistor as shown in FIG. 2 and FIG. 3.

In another specific implementation, the data signal controls the storage device to be charged. After the first transistor transmits the data signal output from the data line to the storage device, the method further includes: the data signal controls the storage device to be charged and the storage device stops charging until the storage device outputs a high voltage signal which is then transmitted to the control terminal of the second transistor; the high voltage signal of the storage device controls the second transistor is in an off-state and the high voltage signal of the storage device is defined as a second output voltage signal in the case that the second transistor is a P-type thin-film transistor as shown in FIG. 2 and FIG. 3.

In Step 306: the second transistor is in an off-state under a control of a second output voltage signal from the storage device.

The above steps of the methods are for a clear description, and may be combined into one step or one step may be divided into several steps, as long as the steps contain an identical logical relationship and fall into the protection scope of the present disclosure. That adding insignificant amendments or designs to an algorithm or process without altering a core design of the algorithm or process falls into the protection scope of the present disclosure.

This embodiment is a drive method embodiment corresponding to the above-mentioned embodiments for the pixel circuit. This embodiment may be implemented in combination with the above-mentioned embodiments for the pixel circuit. Related technical details mentioned in the above-mentioned embodiment for the pixel circuit are still valid in this embodiment and in order to reduce repetition there are no more details herein. Correspondingly, related technical details mentioned in this embodiment may also be applicable to the above-mentioned embodiments for the pixel circuit.

A further embodiment of the present disclosure relates to a display device including the pixel circuit according the above mentioned embodiment.

The pixel circuit on the display device is set in a control panel. The arrangement of the specific pixel circuit is not limited herein. The display device includes at least one pixel circuit for the display of the display device.

In one implementation, the pixel circuit in FIG. 2 is taken as an example. The second transistor T2 is connected to the supply voltage VDD. Thus, a drive voltage between the gate and the source of the second transistor is denoted as: Vgs=VDD−Vctrl. Herein, Vgs denotes a drive voltage of the second transistor, VDD denotes the supply voltage, and Vctrl denotes a voltage value transmitted from the control line. In a specific implementation, through the layout design of the pixel circuit, the influence of the circuit layout or pixel circuit structure layout on VDD and Vctrl is reduced to ensure the luminance uniformity of the pixel circuit in the control board of the display device.

This embodiment is a device embodiment corresponding to the above-mentioned embodiments of the pixel circuit. This embodiment may be implemented in combination with the above-mentioned embodiments of the pixel circuit. Related technical details mentioned in the above-mentioned embodiments of the pixel circuit are still valid in this embodiment and in order to reduce repetition there are no more details herein. Correspondingly, related technical details mentioned in this embodiment may further be applicable to the above-mentioned embodiment.

What is claimed is:

1. A pixel circuit, comprising: a first transistor, a second transistor, a third transistor, a storage device and a light-emitting device; wherein a control terminal of the first transistor is connected to a first scan line, a first terminal of the first transistor is connected to a data line, and a second terminal of the first transistor is connected to an output node; a first terminal of the storage device is connected to the output node, and a second terminal of the storage device is connected to a control line;

a control terminal of the second transistor is connected to the output node, a first terminal of the second transistor is connected to a supply voltage, and a second terminal of the second transistor is connected to a first terminal of the third transistor; and a control terminal of the third transistor is directly connected to a second scan line, a second terminal of the third transistor is directly connected to an anode of the light-emitting device, and a cathode of the light-emitting device is grounded, wherein the second terminal of the storage device is directly connected to the control line so that the light-emitting device emits light under a control of a control signal from the control line, wherein the control signal from the control line is different from the supply voltage so that a control of a luminance evenness of the light-emitting device is realized by the control signal from the control line when a capacity of the storage device is limited.

2. The pixel circuit according to claim 1, wherein the first transistor and the third transistor are of different types, and a voltage signal transmitted from the first scan line and a voltage signal transmitted from the second scan line are the same.

3. The pixel circuit according to claim 1, wherein the first transistor and the third transistor are of a same type, and a voltage signal transmitted from the first scan line and a voltage signal transmitted from the second scan line are opposite to each other.

4. The pixel circuit according to claim 1, wherein the first transistor and the third transistor are switch transistors, and the second transistor is a drive transistor.

5. The pixel circuit according to claim 1, wherein the second transistor is a P-type thin-film transistor, the first terminal of the second transistor is a source, and the second terminal of the second transistor is a drain.

6. The pixel circuit according to claim 5, wherein the first transistor is a P-type thin-film transistor, and the third transistor is an N-type thin-film transistor; and the control terminal of the third transistor is connected to the control terminal of the first transistor.

7. The pixel circuit according to claim 5, wherein the first transistor is a P-type thin-film transistor, and the third transistor is a P-type thin-film transistor.

8. A display device, comprising the pixel circuit according to claim 1.

9. A method for driving a pixel circuit, applied to the pixel circuit according to claim 1, comprising:

controlling, by a first voltage signal output from the first scan line, the first transistor to be in an on-state and controlling, by a third voltage signal output from the second scan line, the third transistor to be in an off-state;

transmitting, by the first transistor, a data signal output from the data line to the storage device, and controlling, by the data signal, the storage device to output a first output voltage signal;

controlling, by a second voltage signal output from the first scan line, the first transistor to be in an off-state, and controlling, by a fourth voltage signal output from the second scan line, the third transistor to be in an on-state;

controlling, by the first output voltage signal of the storage device, the second transistor to be in an on-state, and receiving, by the second transistor via the storage device, a drive signal to drive the light-emitting device through the third transistor;

wherein the drive signal comprises a drive current and/or a drive voltage, wherein the second terminal of the storage device is directly connected to the control line so that the light-emitting device emits light under the control of the control signal from the control line, wherein the data signal controls the storage device to be discharged, after the first transistor transmits the data signal output from the data line to the storage device, the method for driving the pixel circuit further comprises: controlling, by the data signal, the storage device to be discharged and stopping discharging until the storage device outputs a low voltage signal, transmitting, by the storage device, the low voltage signal of the storage device to the control terminal of the second transistor; controlling, by the low voltage signal of the storage device, the second transistor to be in an on-state; wherein, the low voltage signal of the storage device is the first output voltage signal.

10. The method for driving the pixel circuit according to claim 9, further controlling, by the data signal, the storage device to output a second output voltage signal, and controlling by the second output voltage signal from the storage device, the second transistor to be in an off-state.

11. The method for driving the pixel circuit according to claim 9, wherein the controlling, by the third voltage signal output from the second scan line, the third transistor to be in an off-state, such that the light-emitting device is in a non-light-emitting state.

12. The method for driving the pixel circuit according to claim 9, wherein the drive signal is configured to control luminance of the light-emitting device.

13. The method according to claim 9, wherein, the second transistor is a P-type thin-film transistor.

14. The pixel circuit according to claim 1, wherein the control signal from the control line controls a luminance of the light-emitting device via the storage device, such that the luminance of the light-emitting device is directly adjusted by the control signal from the control line.

15. The pixel circuit according to claim 1, wherein there is no intervening element between the control signal from the control line and the second terminal of the storage device.

16. A method for driving a pixel circuit, applied to the pixel circuit according to claim 1, comprising:

controlling, by a first voltage signal output from the first scan line, the first transistor to be in an on-state and controlling, by a third voltage signal output from the second scan line, the third transistor to be in an off-state;

transmitting, by the first transistor, a data signal output from the data line to the storage device, and controlling, by the data signal, the storage device to output a first output voltage signal;

controlling, by a second voltage signal output from the first scan line, the first transistor to be in an off-state, and controlling, by a fourth voltage signal output from the second scan line, the third transistor to be in an on-state;

controlling, by the first output voltage signal of the storage device, the second transistor to be in an on-state, and receiving, by the second transistor via the storage device, a drive signal to drive the light-emitting device through the third transistor;

wherein the drive signal comprises a drive current and/or a drive voltage, wherein the second terminal of the storage device is directly connected to the control line so that the light-emitting device emits light under the control of the control signal from the control line, wherein the data signal controls the storage device to be charged, after the first transistor transmits the data signal output from the data line to the storage device, the method for driving the pixel circuit further comprises:

controlling, by the data signal, the storage device to be charged and stopping charging until the storage device outputs a high voltage signal, transmitting, by the storage device, the high voltage signal of the storage device to the control terminal of the second transistor; controlling, by the high voltage signal of the storage device, the second transistor to be in an off-state; wherein, the high voltage signal of the storage device is a second output voltage signal.

17. The method according to claim 16, wherein, the second transistor is a P-type thin-film transistor.

* * * * *